US006584616B2

(12) United States Patent
Godshaw et al.

(10) Patent No.: US 6,584,616 B2
(45) Date of Patent: Jul. 1, 2003

(54) KNEE PAD CONSTRUCTION

(75) Inventors: Donald E. Godshaw, Evanston, IL (US); Andrezj Redzisz, Skokie, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/902,305

(22) Filed: Jul. 10, 2001

(65) Prior Publication Data

US 2003/0019006 A1 Jan. 30, 2003

(51) Int. Cl.[7] ..... A41D 13/00
(52) U.S. Cl. ..... 2/24
(58) Field of Search ..... 2/24, 16, 22, 455, 2/242, 267, 911, DIG. 3; 128/878, 881, 882; 602/20, 23, 25–27, 62–63, 65

(56) References Cited

U.S. PATENT DOCUMENTS

| | | | | | |
|---|---|---|---|---|---|
| 830,661 | A | * | 9/1906 | Greshnam | 2/24 |
| 967,004 | A | * | 8/1910 | Ehikian | 2/24 |
| 1,055,040 | A | * | 3/1913 | Herron et al. | 2/24 |
| 1,090,446 | A | * | 3/1914 | Boynton | 2/24 |
| 2,195,817 | A | * | 4/1940 | Johnson | 2/24 |
| 4,116,236 | A | * | 9/1978 | Albert | 2/24 |
| 4,287,885 | A | * | 9/1981 | Applegate | 2/24 |
| 5,031,240 | A | | 7/1991 | Nierhaus | |
| 5,500,955 | A | | 3/1996 | Gongea | |
| 5,524,292 | A | * | 6/1996 | Hargens | 2/911 |
| 5,537,689 | A | | 7/1996 | Dancyger | |
| 5,794,261 | A | | 8/1998 | Hefling | |
| 6,223,350 | B1 | * | 5/2001 | McFarlane | 2/24 |

* cited by examiner

*Primary Examiner*—John J. Calvert
*Assistant Examiner*—Tejash D Patel
(74) *Attorney, Agent, or Firm*—Banner & Witcoff, Ltd.

(57) ABSTRACT

A knee pad is designed to accommodate either the left or right hand knee of an individual by providing a doughnut shaped insert within the concave hard shell of the knee pad and wherein the insert is displaced toward the outside edge of the right hand or left hand knee side of the pad for the right knee and left knee, respectively.

7 Claims, 12 Drawing Sheets

FIG.15
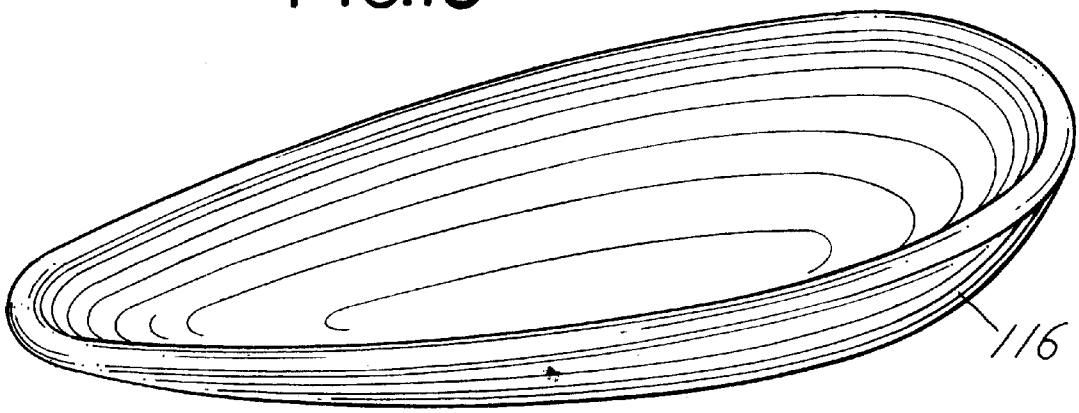
FIG.16
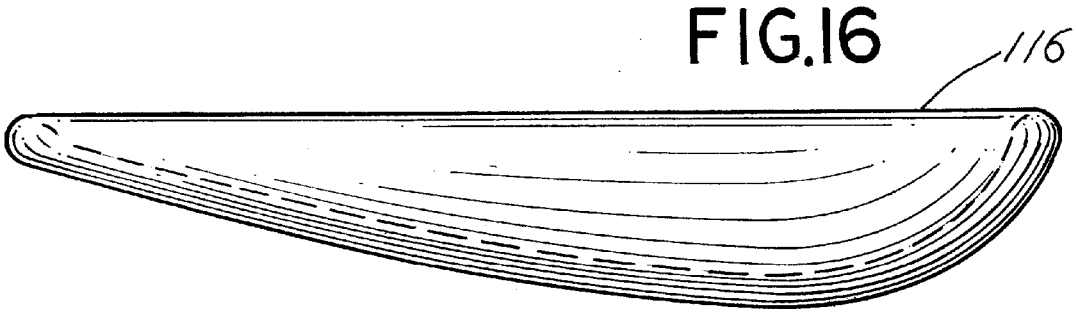
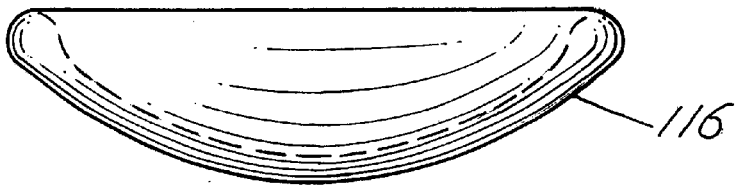
FIG.17

KNEE PAD CONSTRUCTION

BACKGROUND OF THE INVENTION

The present invention relates to a protective knee pad construction, and more particularly, to individual knee pads which are constructed to accommodate the left knee or right knee of an individual.

Protective pads are used by various individuals, for example, construction workers, mechanics, sportsmen, and others, who find it necessary to protect their body parts as a result of their work or activities. Tradespersons, such as carpenters, use knee pads when kneeling on hard surfaces which is a common requirement in their craft. Traditional knee pads comprise rigid pad members that are fitted over the knee and held by attachment straps both above and below the knee.

Improved knee pad constructions have been proposed from time to time, including the knee pad construction set forth in U.S. Pat. No. 6,223,350 for a Molded Knee Pad Construction in the name of McFarlane. Various other patents disclose knee pad constructions including Nierhaus, U.S. Pat. No. 5,031,240 for a Kneepad; Hefling, U.S. Pat. No. 5,794,261 for a Protection Joint Guard; Dancyger, U.S. Pat. No. 5,537,689 for a Protective Knee Pad Having a Single Piece Cupping Means and Stitch Receiving Groove; and Gongea, U.S. Pat. No. 5,500,955 for a Knee Pad for Athletes.

While such knee pads are highly useful, they do not take into account the fact that the left knee of each individual has a distinct shape relative to the right knee of that individual. There are differences, for example, between the shape of the left kneecap relative to the right kneecap, or patella. Although the size of a kneecap and knee may vary from person to person, the general shape and location of the left kneecap and the right kneecaps are very similar from person to person.

Most knee pads, however, are universal in size and in shape and are considered interchangeable with respect to the right and left knees of an individual. As a consequence, the left and right knees of an individual, which are somewhat asymmetric, will not necessarily be accommodated uniformly by a typical, prior art universal knee pad construction. Thus there has developed a need to provide knee pads that accommodate the left and right hand knees of an individual and further to provide knee pads to accommodate knees having variable size, even though the general shape and outline of the respective left and right knee are similar from individual to individual.

SUMMARY OF THE INVENTION

Briefly, the present invention comprises a knee pad construction which includes a generally rigid, molded outer, protective shell or pad having a convex outside shape and a concave inside shape. A resilient toroid member or insert pad is fitted or otherwise incorporated within the concave inside or interior side of the knee pad. In a preferred embodiment, a toroid member includes an opening or reduced thickness in the center for receiving and supporting the kneecap, or knee, of an individual. The shape of the toroid member may be asymmetric, or the toroid member or insert pad may be strategically placed in the shell to accommodate the left or the right knee of an individual as the case may be. Thus, the inserts are designed to provide greater support in the region, or area surrounding the kneecap and to accommodate the unique shape of the right knee or the left knee, as the case may be, by providing a separate, unique knee pad for the right knee and separate, unique knee pad for the left knee. In the preferred embodiment, a fabric or mesh cover fits over the toroid member or insert and is stitched or attached into the interior of the molded knee shell over the insert. Radially extending straps are utilized to attach and hold each knee pad in position on an individual.

Thus, it is an object of the invention to provide an improved knee pad construction.

It is a further object of the invention to provide a knee pad construction wherein a toroidal shaped insert or pad is provided within the interior surface or inside of the molded, outer protection knee pad shell to accommodate the left or the right knee of an individual.

A further object of the invention is to provide a knee pad construction with enhanced comfort and wearability and with a rugged construction that is economical to manufacture.

Another object is to provide a unique knee pad for the left knee and a unique knee pad for the right knee.

These and other objects, advantages and feature of the invention will be set forth in the detailed description which follows.

BRIEF DESCRIPTION OF THE DRAWING

In the detailed description which follows, reference will be made to the drawing comprised of the following figures:

FIG. 15 is an isometric view of insert for the knee pad of FIG. 11;

FIG. 16 is a side elevation of the insert of FIG. 15; and

FIG. 17 is an end elevation of the insert of FIG. 15.

DESCRIPTION OF THE PREFERRED EMBODIMENT

Figure 1:
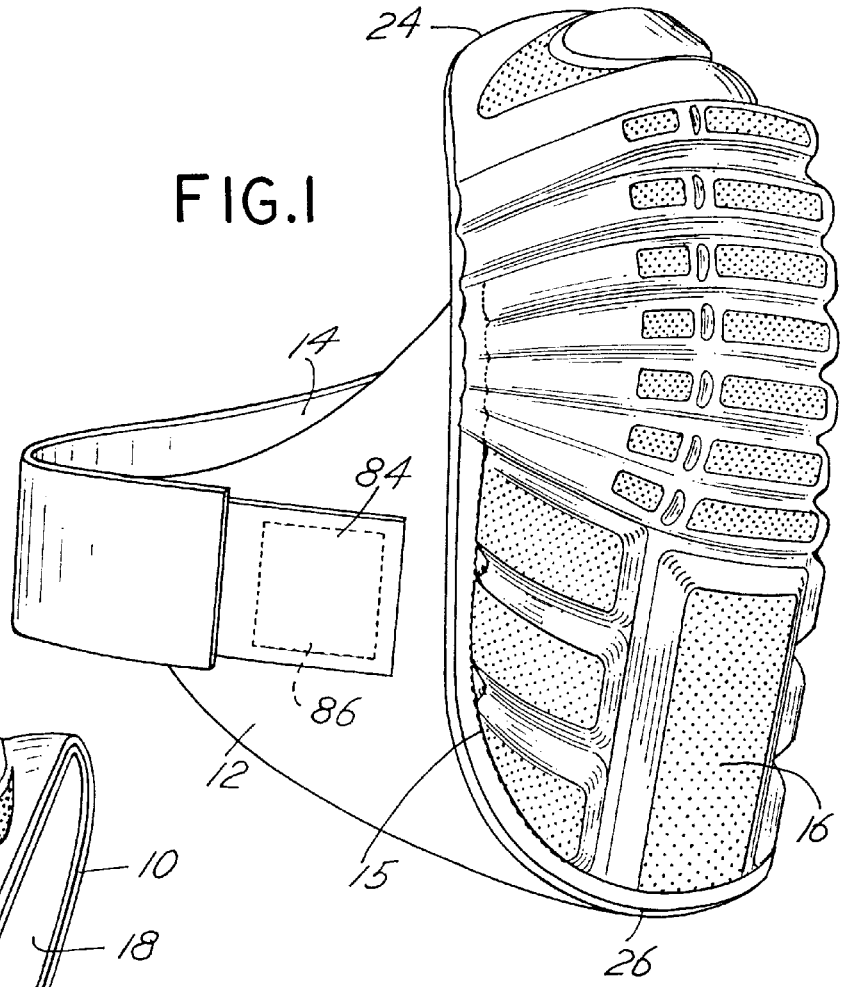
FIG. 1 is a side elevation of the knee pad of the invention.
Figure 2:
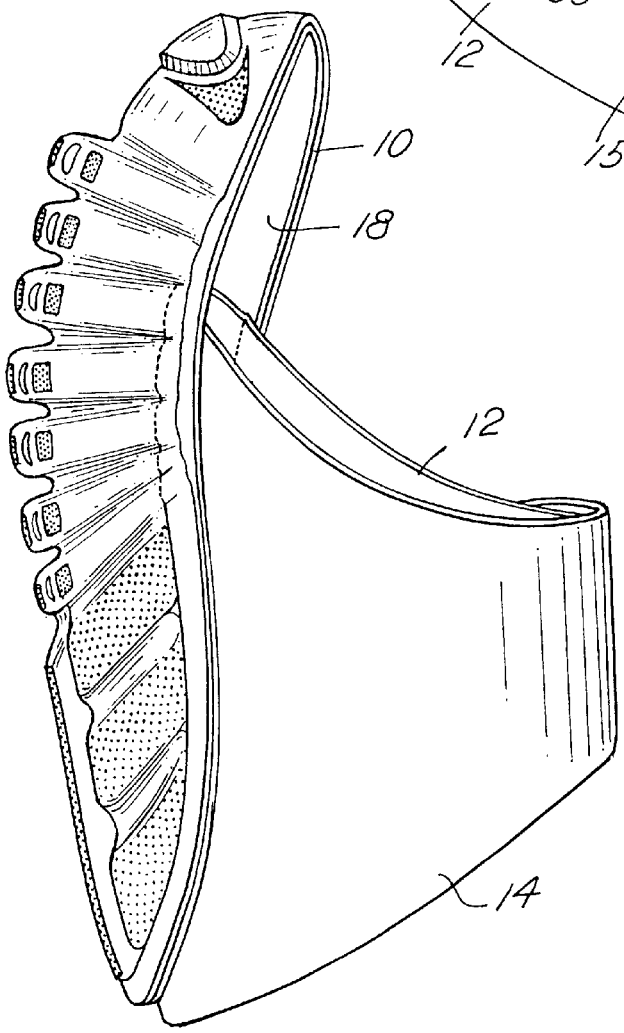
FIG. 2 is the opposite side elevation of the knee pad of FIG. 1.
Figure 3:
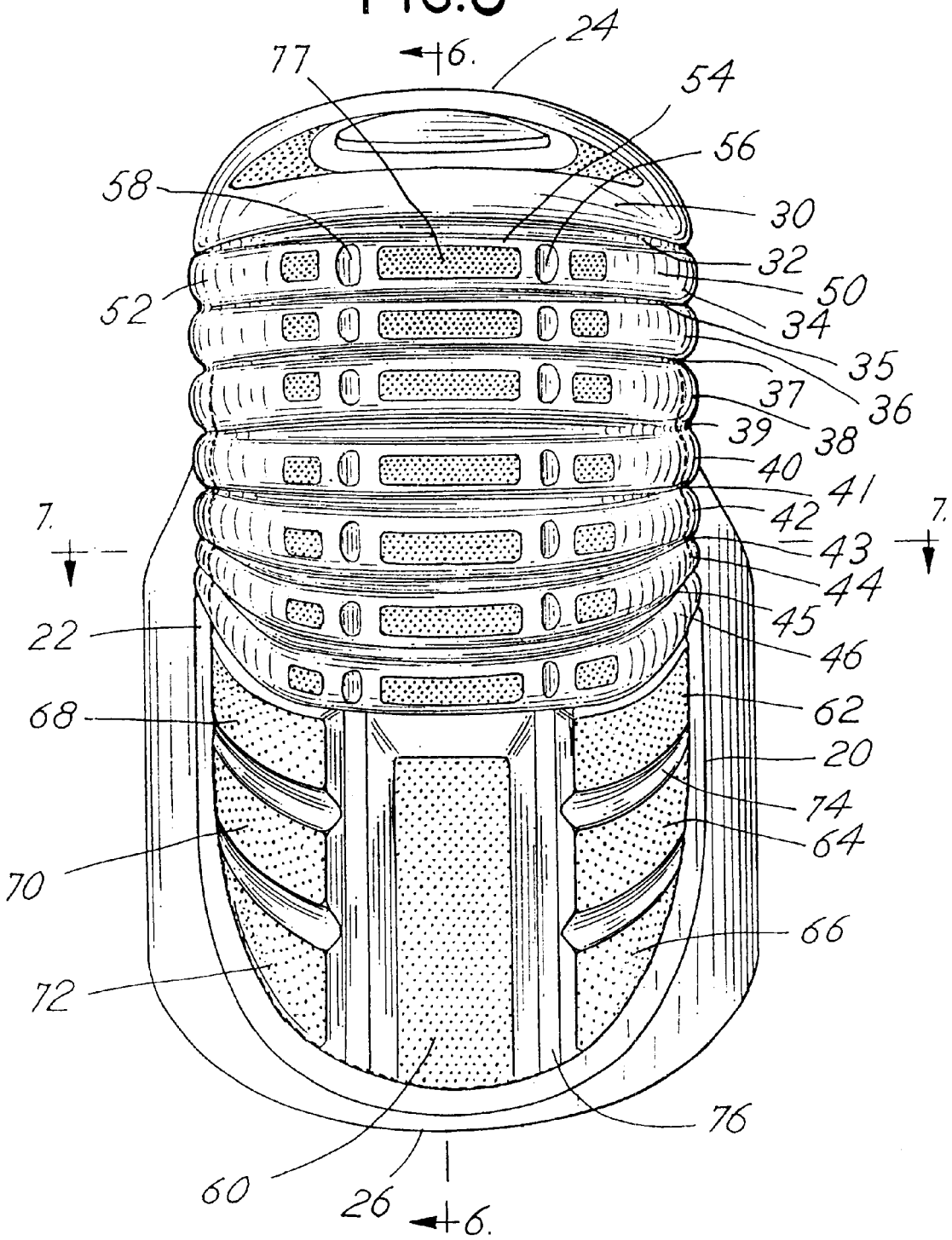
FIG. 3 is a front elevation of the knee pad.
Figure 4:
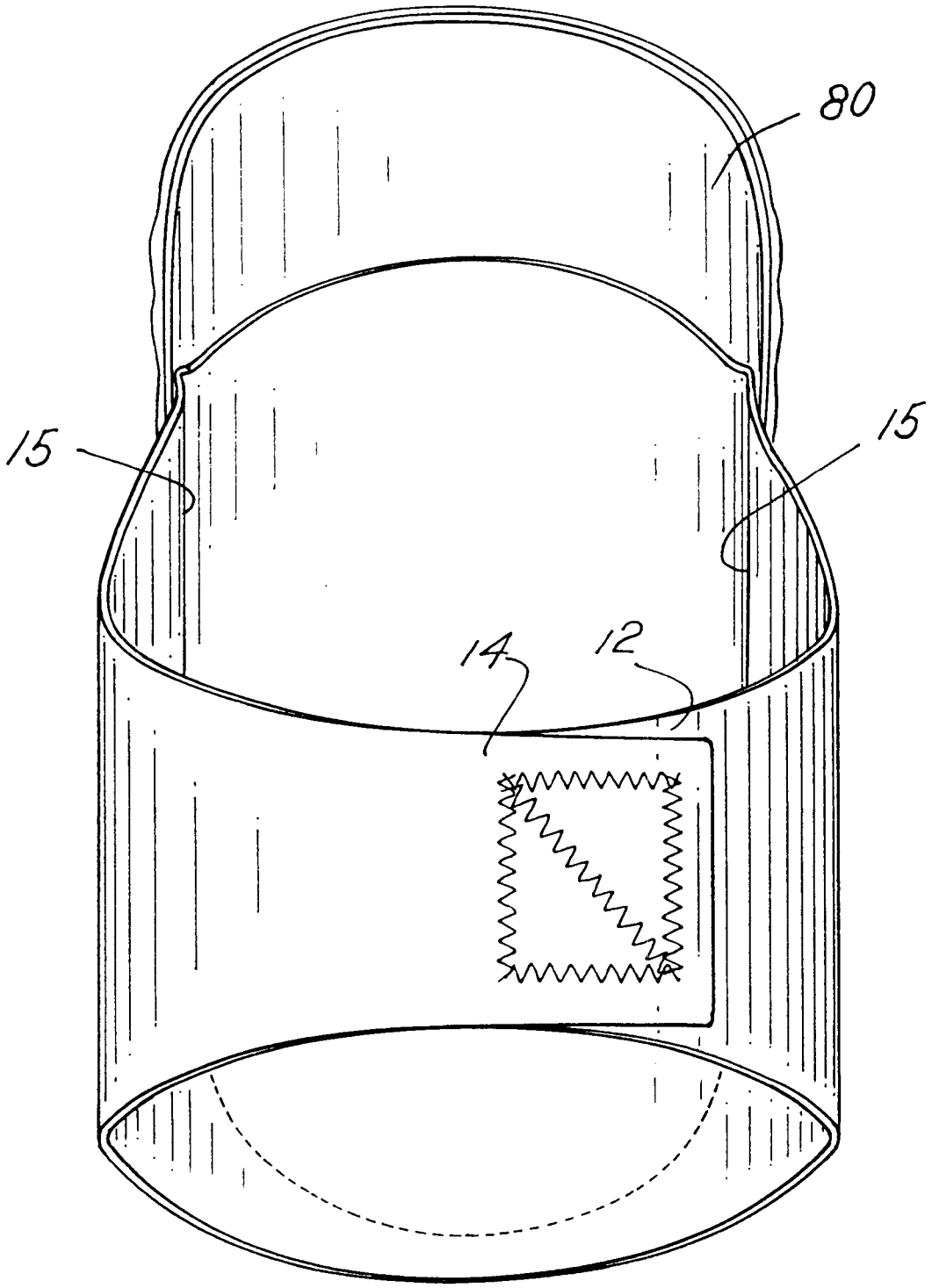
FIG. 4 is a back side elevation of the knee pad.
Figure 5:
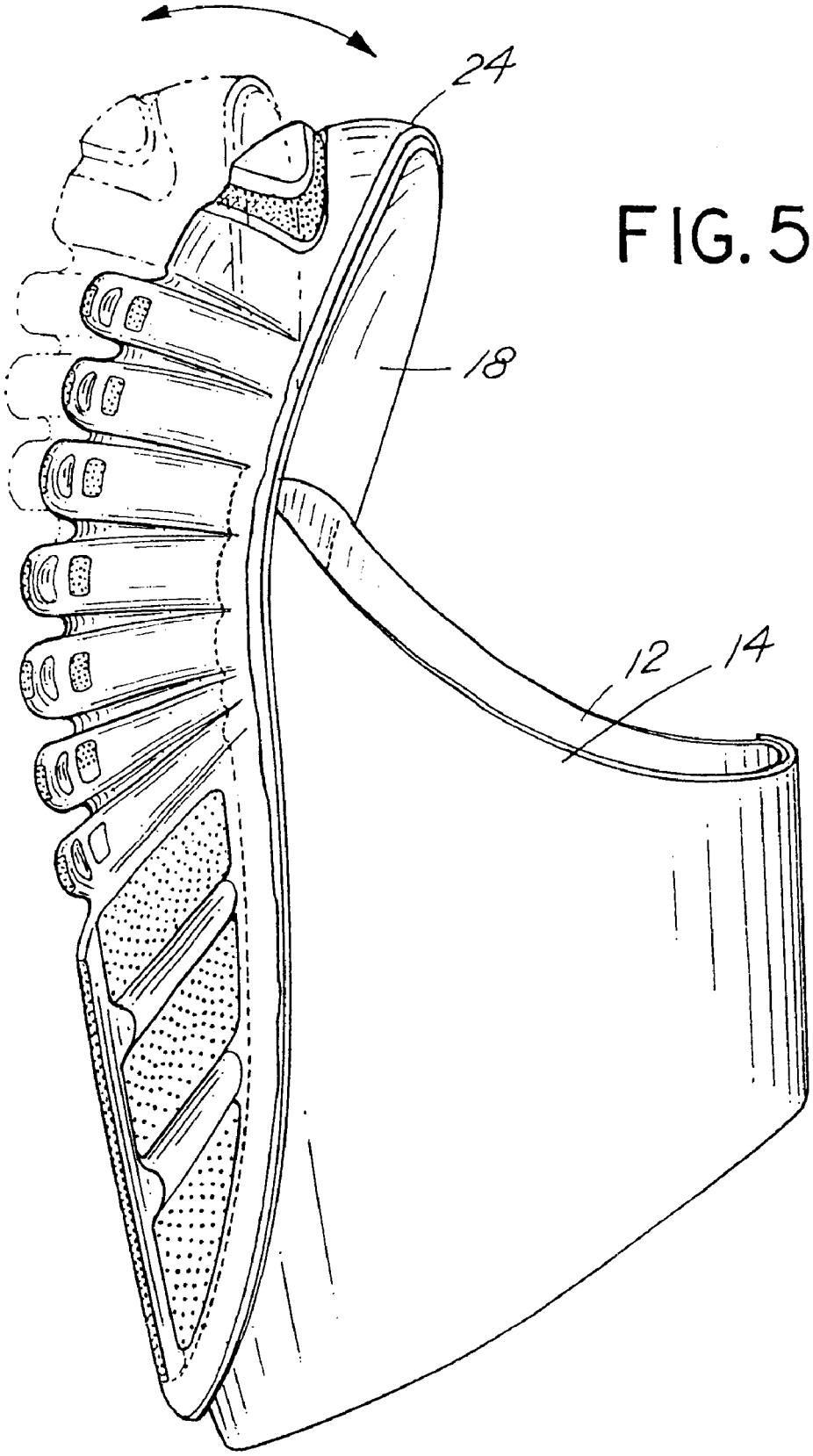
FIG. 5 is an elongate cross sectional view of the knee pad of FIG. 3 taken along the line 5—5.
Figure 6:
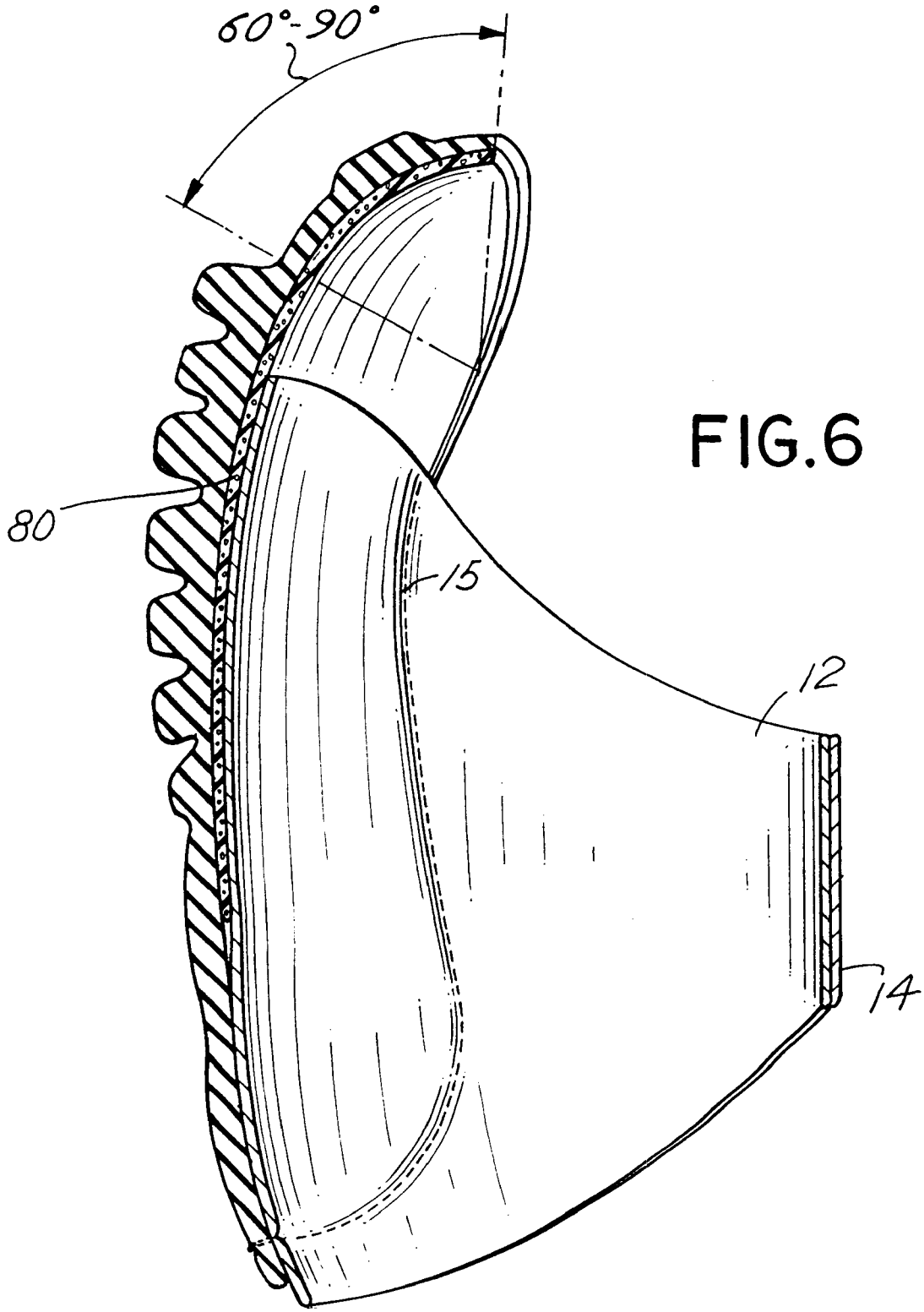
FIG. 6 is a cross sectional review of the knee pad of FIG. 3 taken along the line 6—6.
Figure 7:
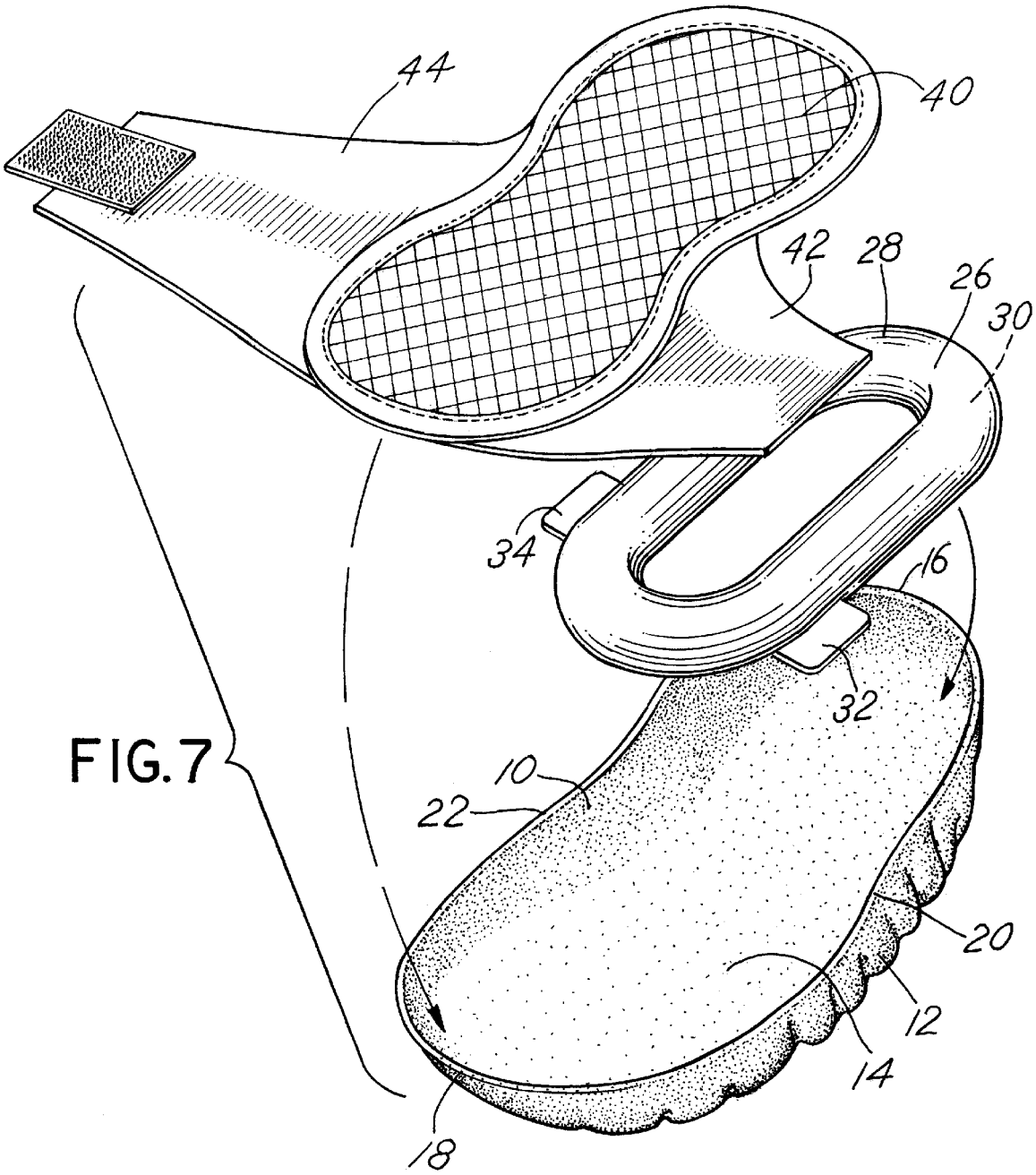
FIG. 7 is an exploded isometric view of the knee pad of the invention.
Figure 9:
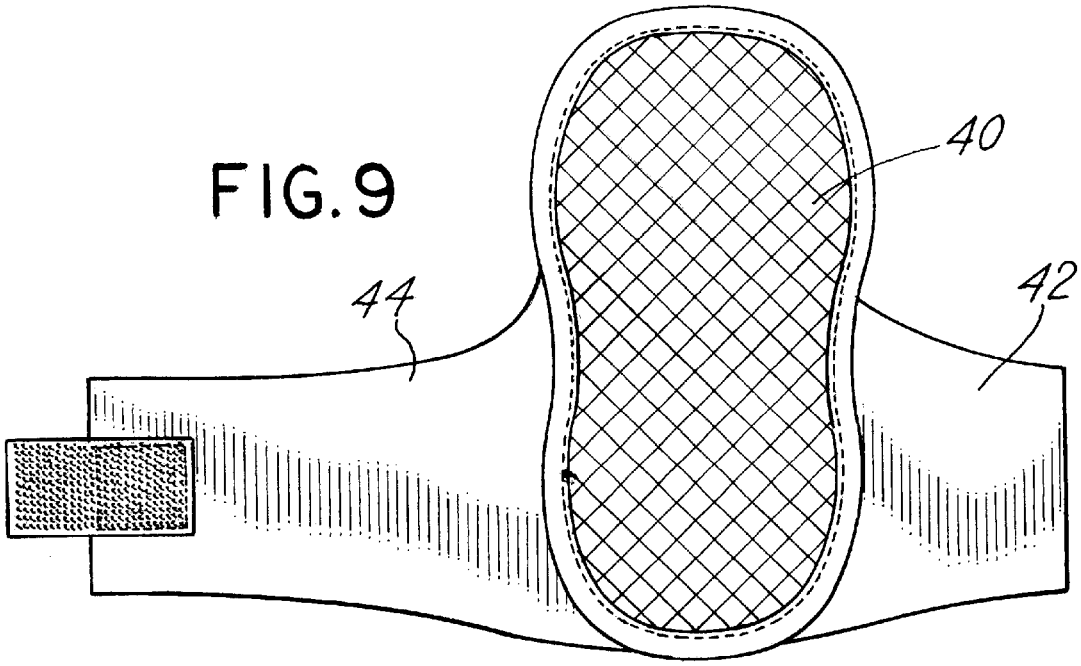
FIG. 9 is a plan view of the backside of the knee pad of FIG. 8.

Referring to the Figures, the knee pad of the invention includes a molded, generally hard, protective, but slightly flexible outer shell 10 having a convex outer face or surface 12 and a concave inner face or surface 14. The shell 10 may be molded from a rubber material for example, or a plastic material. The shell 10 includes a top edge 16, a, spaced, generally parallel lower or bottom edge 18, a first lateral side edge 20, and a second lateral side edge 22 spaced from the first lateral side edge 20. The configuration of the outer surface 12 of shell 10 may be similar to that, for example, as shown in U.S. Pat. No. 6,223,350, but is not limited to such a configuration.

Positioned within the shell 10 against the concave inside surface 14 is a toroid insert or an insert pad member 26 that is generally comprised of a plastic sleeve or sack filled with gel material. For example, a doughnut shaped plastic membrane 28 may be filled with a gel substance 30 to provide a toroidal shaped element 26 which is positioned against the backside of shell 10 or against the inside concave surface 14. The toroidal shape may be formed from a plastic membrane with optional wing members 32 and 34. The wing members 32, 34 may be sewn to the inside surface of 14 of the shell 10 to maintain pad member 26 in a desired position. An adhesive material may also be utilized to attach pad member or insert 26 and maintain the toroid insert 26 in position.

A protective fabric or mesh cover 40 is sewn or fitted over the insert 26 and attached to shell 10 by peripheral stitching. Elastic straps 42 and 44 are attached to the cover 40 and project from side edges 18, 20 of shell 10. The cover 40 and straps 42, 44 may thus be sewn in place and positioned against the insert 26. The straps 42 and 44 are preferably a neoprene material which may include perforations to facilitate the circulation of air to the back of the knee when the knee pad is attached to the knee. The ends of straps 42, 44 overlap and fasten together, for example, by a hook-end eye (Velcro) fastener below the knee joint.

In the preferred embodiment, a generally elliptically shaped insert or pad 26 is utilized. However, other insert 26 shapes may be utilized. Preferably, the insert or pad 26 also has a constant cross sectional area transverse to the axis of the toroid. That is, the cross sectional area of the toroid is uniform about the circumference of the toroid and the insert or pad 26 has an oval shape. Alternatively, the toroid insert or pad 26 may have an asymmetric shape. In any event, it is important that the configuration of the toroid insert 26, as well as the placement thereof against the concave surface 14, be designed so that the cushioning for the knee is asymmetrically positioned relative to a vertical center line axis 50 through the shell 10.

Figure 8:
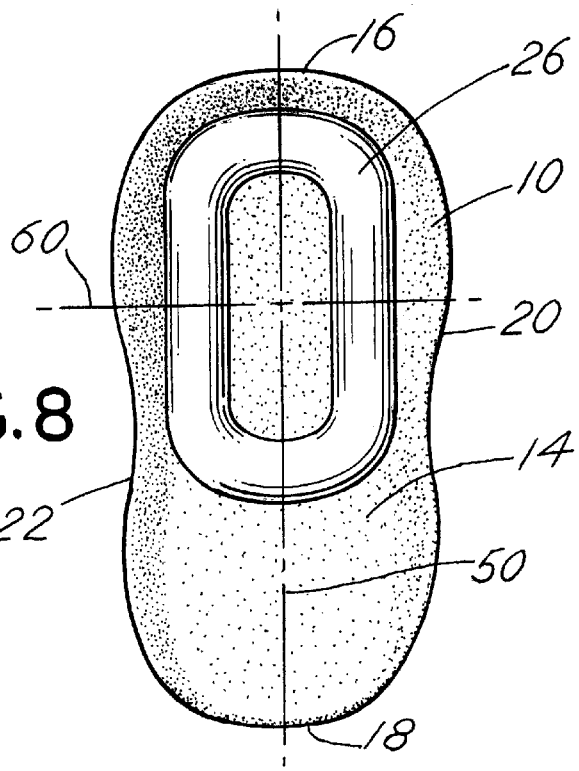
FIG. 8 is a top plan view of the right hand or right knee pad embodiment of the invention depicting the outer shell and the toroid insert.
Figure 10:
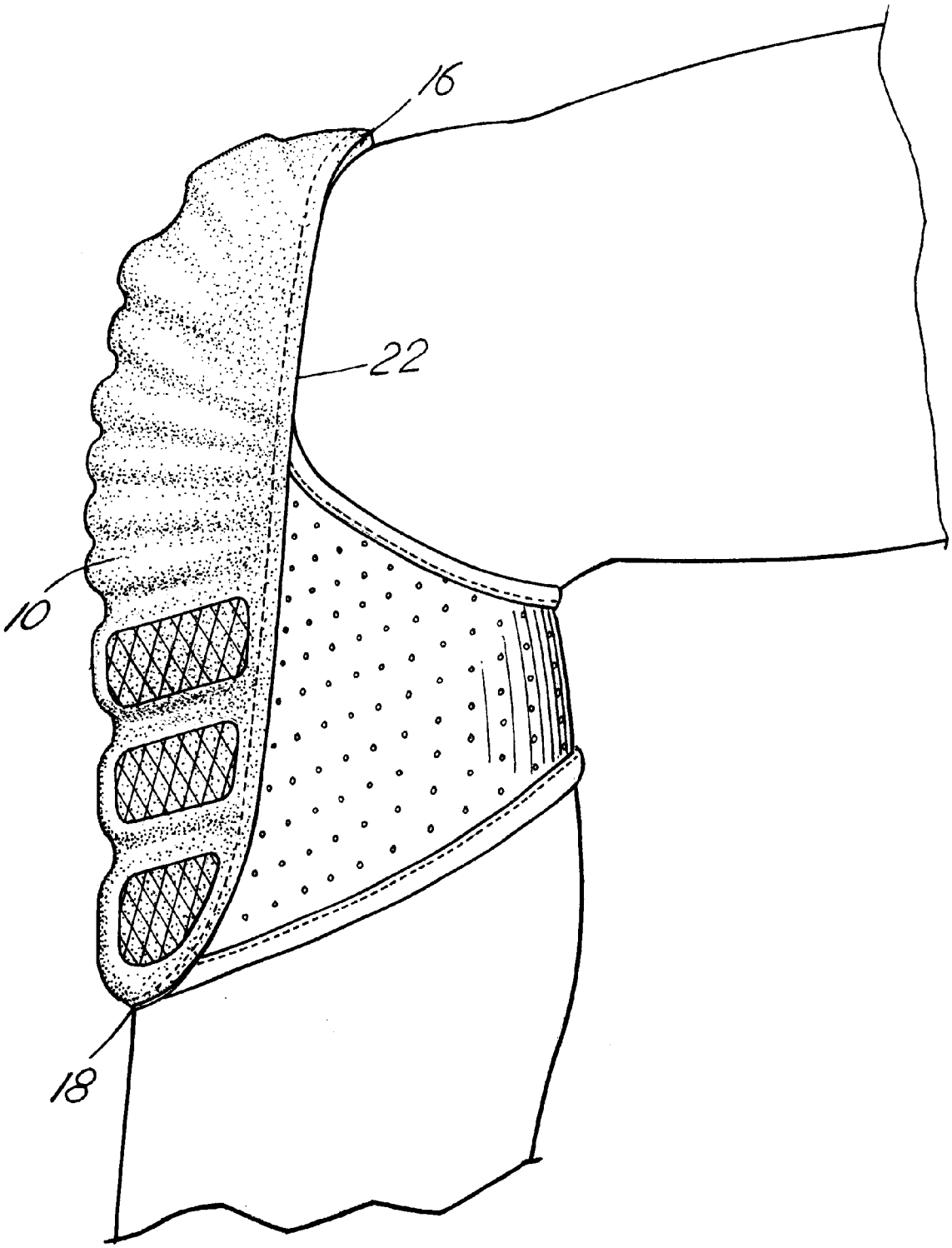
FIG. 10 is an isometric view of the knee pad of the invention as placed on one knee of an individual.
Figure 11:
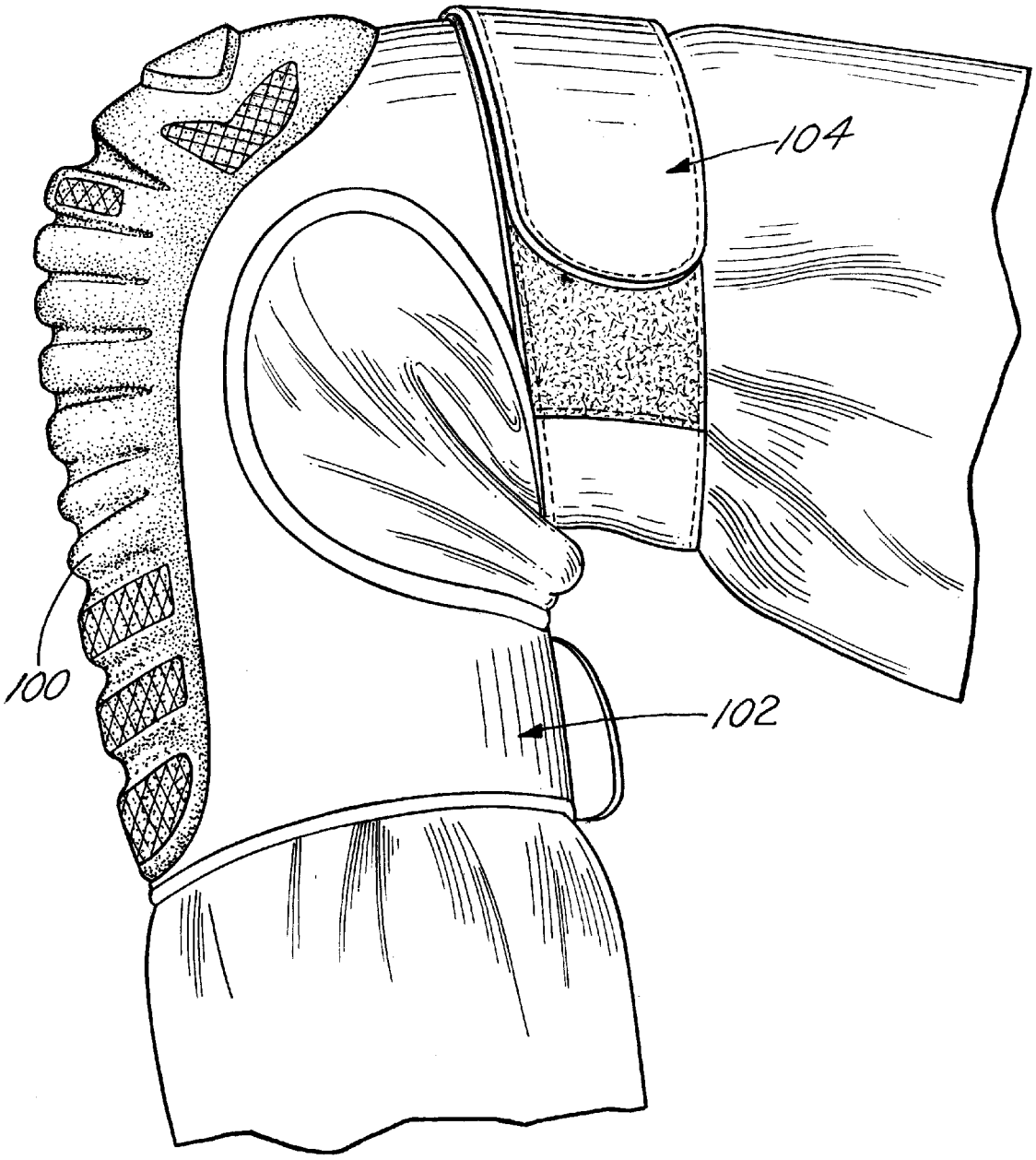
FIG. 11 is an alternative embodiment of the invention wherein the knee pad utilizes two pairs of straps to attach the knee pad over the knee joint.

Thus referring to FIG. 8 there is depicted the positioning of the toroid pad or insert 26 for the right knee pad of a pair of left and right knee pads. Toroid pad or insert 26 for a right knee is displaced to the right or toward the outside edge 20 of the shell 10. Thus, the gel filled pad, ring or insert 26 in FIG. 8 is especially designed for support and protection of the right knee of an individual by placing the insert 26 to the right of the center line axis 50 as viewed from the concave or backside 14.

The left hand knee pad provides displacement of the toroid insert or pad 26 to the left of the vertical center line 50 of shell 10, or in other words provides that the shape of the toroid pad 26 effectively provides more support toward the left hand edge 22 of the shell 10 as viewed from the backside 14 of shell 10 in FIG. 8. Additionally, the toroid for both the left and right knees is oval shaped or elongated or ellipsoid in shape as viewed in FIG. 8 with the major axis aligned generally vertically. Also, the pad or insert 26 is positioned for alignment of the toroid or insert 26 in the top two-thirds of the shell 10. Thus a midline axis 60 through the toroid or insert 26 generally is typically aligned with the boundary between the top one-third and the bottom two-thirds of the shell 10.

Figure 12:
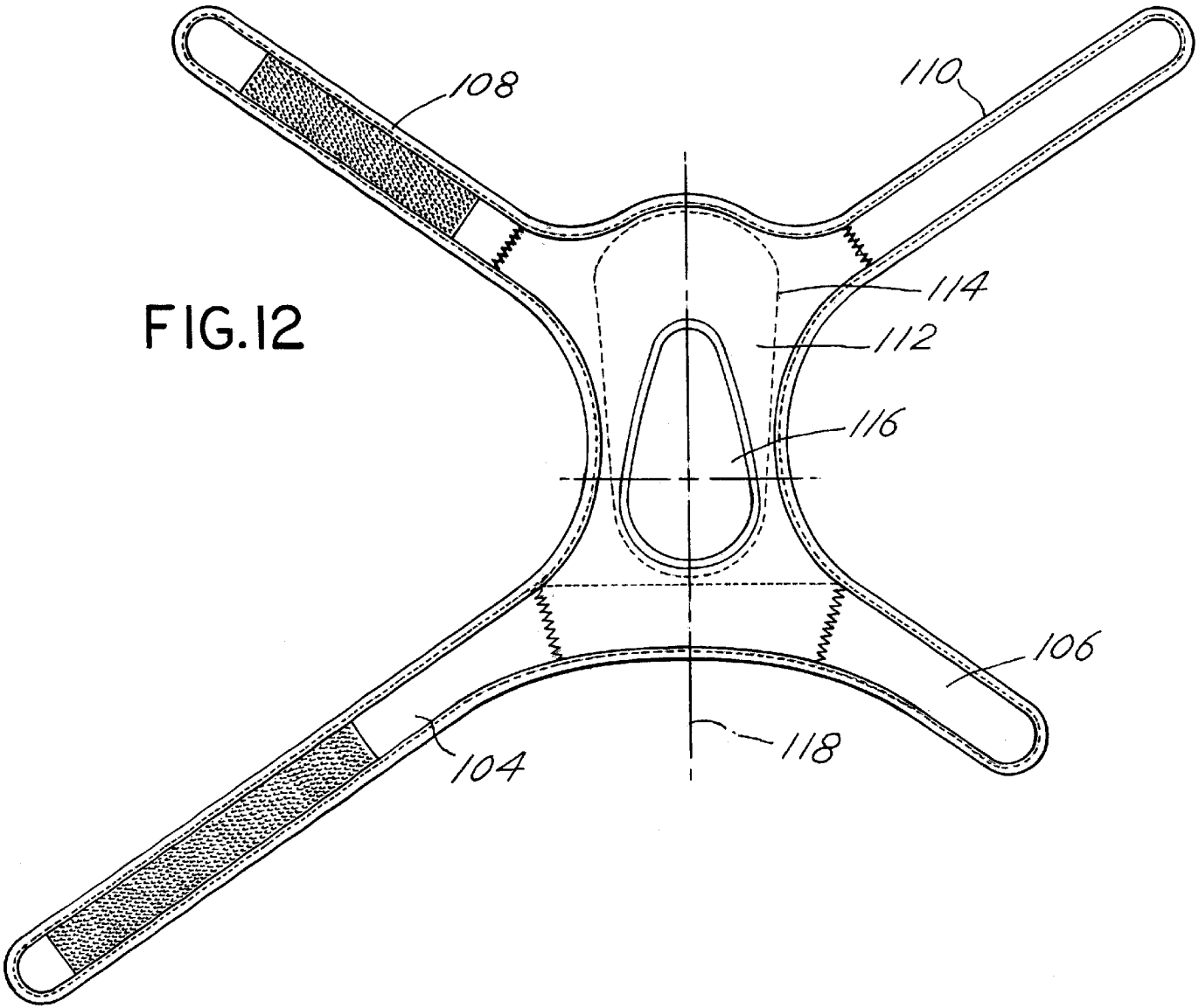
FIG. 12 is a plan view of the assembly for the straps and mechanism for facilitating maintenance of the cushion insert within the knee pad of FIG. 11.

FIGS. 11–17 illustrate a second embodiment and other features of the invention. A knee pad includes an outer shell 100 fabricated from material as previously described. Attached, for example, by stitching around the periphery of the outer shell 100 is a flexible fabric or neoprene strap construction 102. The strap construction of FIGS. 11–14 includes a pair of straps; namely, a lower strap comprised of a first lower strap extension 108, a second lower strap extension 110, an upper strap comprised of a first upper strap extension 104, and a second, upper connectable strap extension 106. The strap extensions 104, 106, 108 and 110 extend outwardly, generally radially from a central body portion 112 as depicted in FIG. 12. It will be noted that the central body 112 is stitched about a stitch line 114 to the outer periphery of the shell 100. The angular direction of extensions 104, 106, 108, and 100 is chosen so that the pairs of extensions 104, 106, and 108, 110 will not bind or bunch when connected around the back of the knee.

Figure 13:
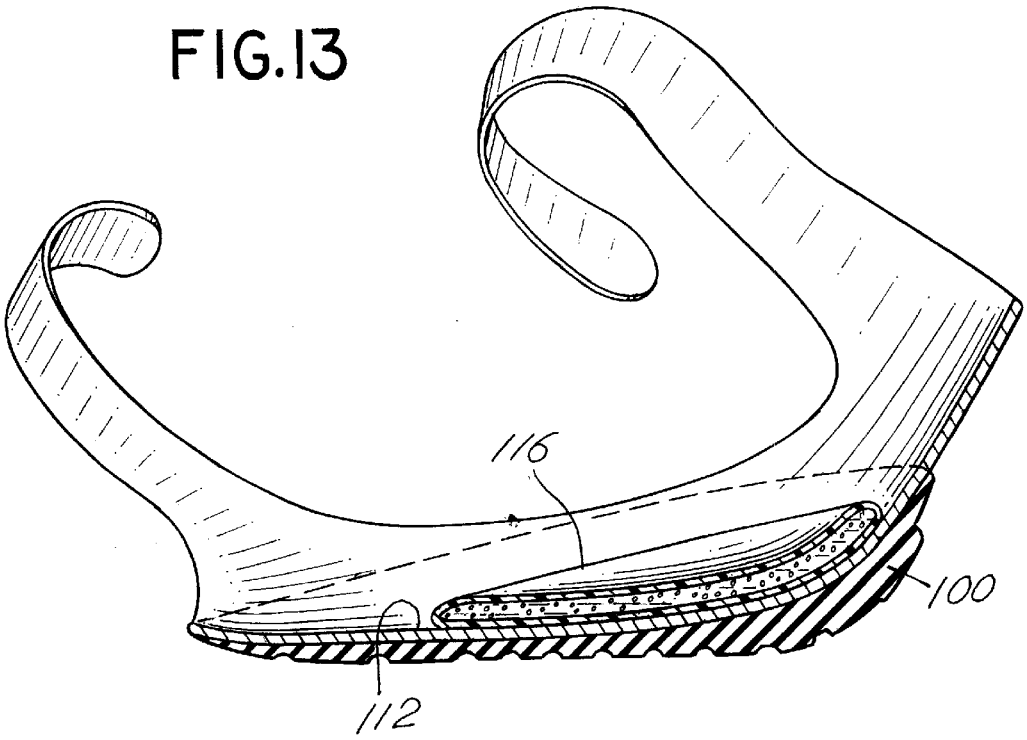
FIG. 13 is a side cross sectional view of the knee pad of FIG. 11.
Figure 14:
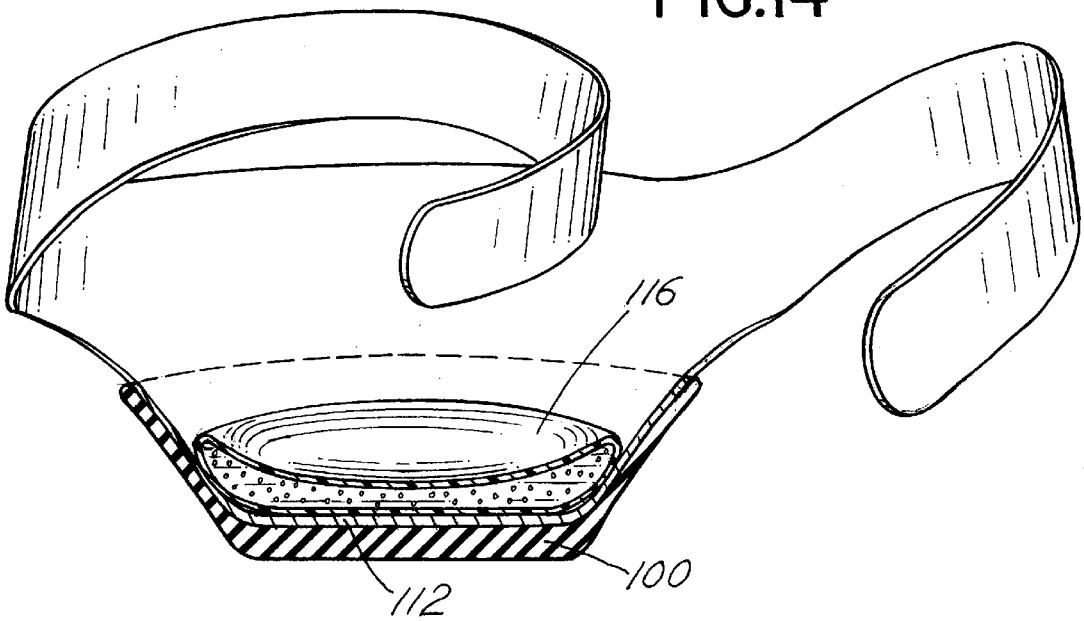
FIG. 14 is a cross sectional view at right angles to the view of FIG. 13.

Positioned on the inside of the strap construction 102 against the inside face of shell 100 is an insert 116 that is comprised of a gel material or a plastic skin filled with a gel material. The insert 116 has a generally ellipsoid shape. The ellipsoid 116 is positioned generally centrally on a vertical axis 118 and in the upper ⅔ of the knee pad shell 100 That is, the straps 104 and 106 attach the knee pad to the upper thigh. The straps 108 and 110 attach the knee pad to the leg below the knee. The insert 116 is positioned adjacent the upper straps 104 and 106 and thus in the upper ⅔ of the shell 100. FIG. 13 depicts in cross section the positioning of the gel filled pad, or insert 116.

The pad 116 is partially filled so that the gel within the pad may move to the side when one puts their knee in the knee pad. This accommodates the shape of the knee for either the left or the right knee and also provides that the knee will be evenly and equally supported about the periphery of either the left or right knee and kneecap.

The insert 116 is preferably in the form of a tear drop as viewed in plan view with the wider dimension of the insert or pad 116 at the upper end of shell 100. The pad 116 is typically a plastic sack which is partially gel filled to enable comfortable support in a manner which permits the patella or kneecap to fit into the center of the pad 116. However, various other arrangements may be provided and are considered to be within the scope of the invention. That is, a toroid may be formed of discontinuous elements or formed from a series of cushion supports forming a general circumferential pattern on the inside of the shell 10 or 100 with extra support and displacement of the support to the right for the right hand knee pad and to the left in the left knee pad. Also, the pad 116 or 26 may be in the form of a gel which will conform to the shape of the knee and kneecap when the knee impresses against the center. The insert 26 or pad 116 would then be directed against the total knee joint or kneecap and balanced support surrounding the knee joint would result. In addition to a gel filled plastic ring, other types of support materials may be used, for example, foam rubber supports may be used in lieu of a gel insert. However, the preferred function of a pad or insert 26, 116 is deformation and positioning to conform to knee shape, to distribute forces and to accommodate the left or right knee as the case may be.

Thus while there has been described a preferred embodiment of the invention, it is to be understood that the invention is to be limited only by the following claims and equivalents thereof.

What is claimed is:

1. A set of kneepads, said set comprising, in combination:

a right kneepad including:

a molded shell having a convex shaped outside, a concave inside, and lateral sides;

a cushion insert on the inside said insert in the form of a closed, elliptical shaped toroid with an open center and shaped to support a right knee, said shell having a vertical axis, said toroid having a vertical axis displaced in the right-hand sense laterally from the shell vertical axis; and a retaining member connected to the lateral sides for retention of the insert on the knee; and a left kneepad including:

a molded shell having a convex shaped outside, a concave inside, and lateral sides;

a cushion insert on the inside said insert in the form of a closed, elliptical shaped toroid with an open center and shaped to support a left knee, said shell having a vertical axis, said toroid having a vertical axis displaced in the left-hand sense laterally from the shell vertical axis; and a retaining member connected to the lateral sides for retention of the insert on the knee.

2. The knee pad construction of claim 1 wherein the insert comprises a toroid having a plastic skin filled with a gel.

3. The knee pad construction of claim 1 wherein the shell is symmetric about a center line axis midway between the lateral sides and wherein the insert is asymmetric with respect to the axis.

4. The knee pad construction of claim 1 wherein the retaining member comprises an elastomeric strap.

5. The knee pad construction of claim 1 wherein the inside of the shell further includes a flexible material cover over the insert.

6. The knee pad construction of claim 1 wherein the insert comprises a toroid having a variable cross sectional area about its circumference.

7. The knee pad construction of claim 1 wherein the insert construction comprises a toroid having a greater cross sectional area on the lateral side associated with the outside of the knee.

* * * * *